US009265323B1

(12) United States Patent
Campbell

(10) Patent No.: US 9,265,323 B1
(45) Date of Patent: Feb. 23, 2016

(54) MODULAR DECORATIVE HEADBAND

(76) Inventor: Lindsay Campbell, Boise, ID (US)

( * ) Notice: Subject to any disclaimer, the term of this patent is extended or adjusted under 35 U.S.C. 154(b) by 0 days.

(21) Appl. No.: 13/604,476

(22) Filed: Sep. 5, 2012

(51) Int. Cl.
*A45D 8/00* (2006.01)
*A45D 8/36* (2006.01)

(52) U.S. Cl.
CPC ..... *A45D 8/36* (2013.01)

(58) Field of Classification Search
CPC ..... A45D 8/00; A45D 8/02; A45D 8/36
USPC ..... 132/273–275; D28/41; 2/244, DIG. 11, 2/171, 174
See application file for complete search history.

(56) References Cited

U.S. PATENT DOCUMENTS

| | | | | |
|---|---|---|---|---|
| 2,709,261 | A | 5/1955 | Ruby | |
| 5,692,243 | A | 12/1997 | Chang | |
| 5,901,381 | A | 5/1999 | Nelson | |
| 5,946,728 | A | 9/1999 | Tane | |
| 6,263,884 | B1 | 7/2001 | Minnelli | |
| 6,470,896 | B1 | 10/2002 | Mensonides | |
| 6,513,167 | B1 | 2/2003 | Cheng | |
| 2002/0100489 | A1 | 8/2002 | Minnelli | |
| 2006/0027245 | A1 | 2/2006 | Spector | |
| 2007/0094768 | A1 | 5/2007 | Moudgill | |
| 2008/0169001 | A1* | 7/2008 | Shyu | 132/275 |
| 2008/0178902 | A1 | 7/2008 | Moeszinger | |
| 2008/0302382 | A1* | 12/2008 | Wang | 132/273 |
| 2009/0101162 | A1* | 4/2009 | Hsu | 132/273 |
| 2009/0145455 | A1 | 6/2009 | Saponaro | |
| 2009/0178690 | A1* | 7/2009 | Olson | 132/275 |
| 2009/0277468 | A1* | 11/2009 | Hsu | 132/273 |
| 2010/0212685 | A1 | 8/2010 | Garza | |
| 2012/0118317 | A1* | 5/2012 | Payne | 132/275 |

* cited by examiner

*Primary Examiner* — Rachel Steitz
(74) *Attorney, Agent, or Firm* — Jeffrey Parry Intellectual Property Law Group PLLC; Jeffrey C. Parry

(57) ABSTRACT

A decorative headband having modular detachable decorative ribbons or other attachments. The wearer may select such attachments to accessorize to selected outfits or for other aesthetic purposes. The attachments include fabric ribbons manufactured from natural or artificial fabric, including cotton, silk, polyester, blends thereof, and the like. Attachments may be removably attached to the headband by hook-and-loop type attachments, buttons, hooks, clasps, pins, hooks, or other known attachment mechanisms.

7 Claims, 3 Drawing Sheets

MODULAR DECORATIVE HEADBAND

BACKGROUND

1. Technical Field

The present disclosure relates generally to a modular headband. More particularly, the disclosure relates to a headband having removable and interchangeable ribbons or other attachments to selectively customize and accessorize a headband according to a wearer's outfit and preference.

2. Background

One common type of headband with wide appeal is the resilient horseshoe-shaped headband, which may be referred to at times as an "Alice band." Such resilient headbands may typically be manufactured from flexible metal, plastic, or the like in a variety of shapes, thicknesses, and sizes. Resilient headbands may further be covered with a thin layer of fabric, leather, or other covering material for aesthetic or comfort purposes. Such covering material is typically permanently adhered to the headband and therefore not easily interchangeable nor customizable according to the wearer's wishes. Accordingly, a wearer typically owns numerous headbands having a variety of colors and patterns in order to accessorize one of her headbands with a selected outfit.

What is needed, therefore, is a modular headband that allows a wearer to selectively and interchangeably add decorative elements according to her current outfit and other accessories.

SUMMARY

In one embodiment, a modular, decorative, resilient, and horseshoe-shaped headband has a top surface, a bottom surface, two distal ends where attachment mechanisms are located, and multiple decorative accessories. The decorative accessories are removably attachable to the attachment mechanisms on the headband.

In another embodiment, a method of accessorizing a resilient horseshoe-shaped headband to a wearer's outfit includes: putting the headband having two distal ends onto the wearer's head; selecting a decorative accessory to match with an outfit of the wearer; and attaching the decorative accessory to at least one distal end.

The present disclosure will now be described more fully with reference to the accompanying drawings, which are intended to be read in conjunction with both this summary, the detailed description, and any preferred or particular embodiments specifically discussed or otherwise disclosed. This disclosure may, however, be embodied in many different forms and should not be construed as limited to the embodiments set forth herein; rather, these embodiments are provided by way of illustration only so that this disclosure will be thorough, and fully convey the full scope of the invention to those skilled in the art.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
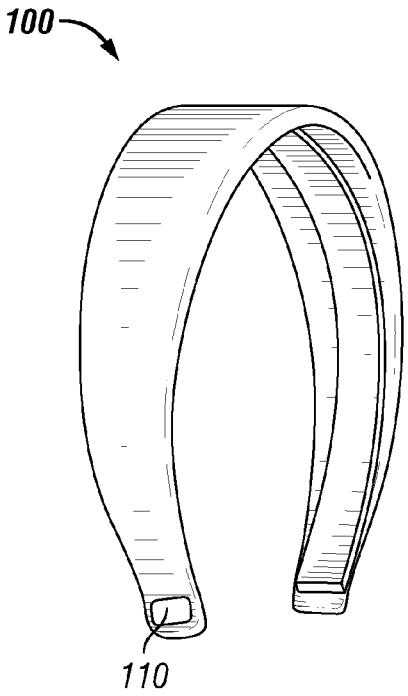
FIG. 1 depicts a decorative headband of the present disclosure.

With reference to FIG. 1, the headband system of the present disclosure comprises a resilient horseshoe-shaped headband 100. The headband 100 may be manufactured from plastic, metal, wood, leather, or any other material known in the art having desirable properties that one of ordinary skill in the art having the benefit of this disclosure would understand. The headband 100 may be partially or completely covered by a covering material of fabric, leather, or other suitable material that provides desired aesthetic properties to the headband 100.

Embodiments of the present disclosure comprise attachment mechanism 110 located at the distal ends of headband 100. As depicted in FIG. 1, attachment mechanism 110 is located on the top (or outer) surface of headband 100. In alternative embodiments, attachment mechanism is located on the bottom (or inner) surface of headband 100. In other embodiments, attachment mechanism is located on the downward facing end surface of the headband 100. Depending on the type of attachment mechanism used (as will be discussed below), one of ordinary skill in the art will understand that an optimal or preferable specific location of an attachment mechanism may depend on the type of attachment mechanism used.

Figure 2:
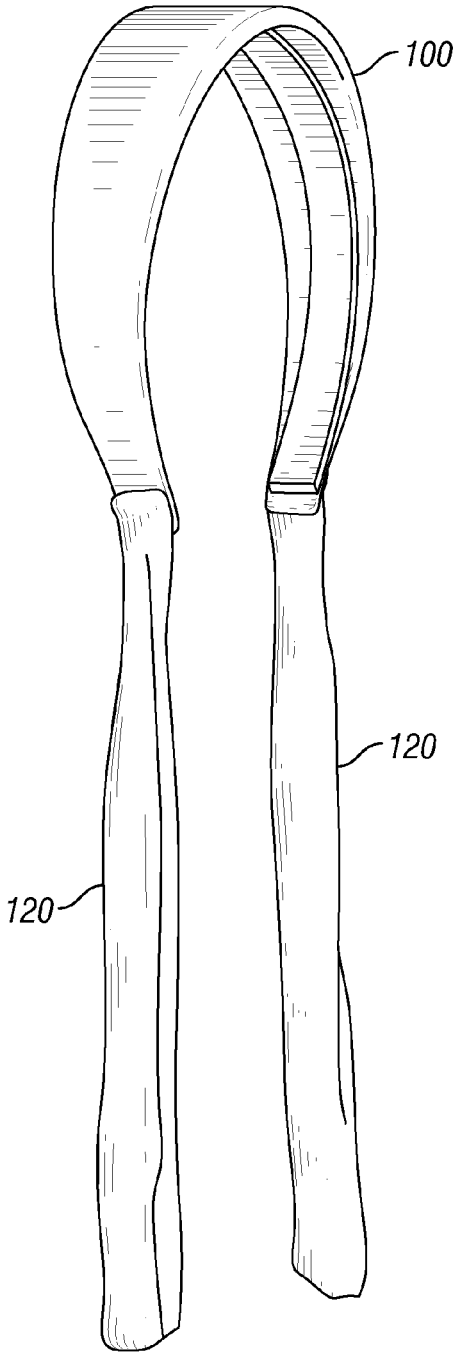
FIG. 2 shows a decorative headband of the present disclosure having attached decorative strips.

As depicted in FIG. 2, embodiments include accessory decorative strips 120 that may be attached to headband 100 at attachment mechanism 110. Embodiments comprise an attachment mechanism on the decorative strips 120 that corresponds to attachment mechanism 110 on the headband 100. Decorative strips 120 may exhibit a variety of aesthetic qualities, as selected by the wearer or sold in conjunction with matching headbands 100 to allow the wearer to coordinate her outfit with headband 100 and decorative strip 120.

In embodiments of the present disclosure, attachment mechanism 110 comprises a hook-and-loop type fastener, commonly known as Velcro. Such a fastener allows the wearer to quickly and easily affix an accessory decorative strip 120 to the headband 100. In alternative embodiments, attachment mechanism 110 comprises one of any number of attachment mechanisms known in the art. For example, embodiments comprise a hinged clasp, a pin, a clip, an adhesive, a magnet, button, snap, or a spring-loaded clasp or hook and corresponding loop.

In certain embodiments comprising a button and/or buttonhole attachment mechanism 110, a button is attached at or near the distal ends of headband 100. The button may be located on the top (or outer) surface or the bottom (or inner) surface of headband 100. In alternative embodiments, the button is located on forward or rear-facing surfaces of headband 100. A corresponding buttonhole is located on decorative strip 120, into which a user may insert the button to thereby removably secure decorative strip 120 to headband 100. Buttons may be attached to headband through any means known in the art, including glue or the like, sewing, and stapling. In alternative embodiments, headband 100 comprises buttonholes at or near each distal end. In such embodiments, decorative strips 120 comprise a button that corresponds to buttonholes and which wearer can insert into buttonholes to removably secure decorative strip 120 to headband 100.

Figure 4:
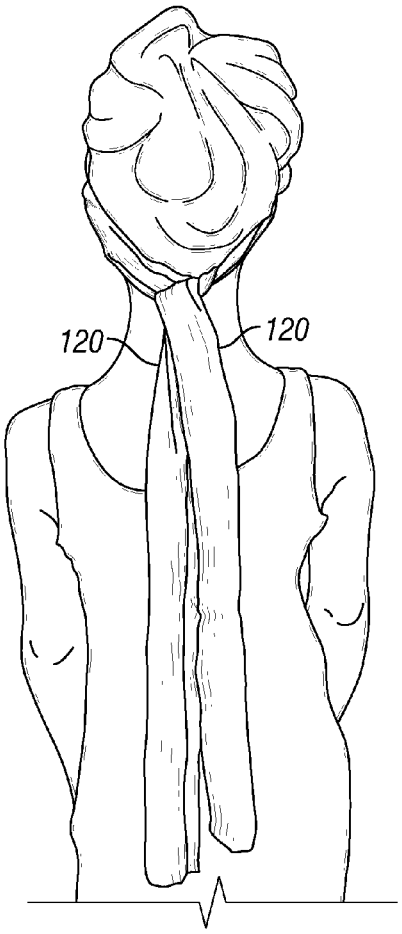
FIG. 4 depicts a rear view of a person wearing the decorative headband.
Figure 5:
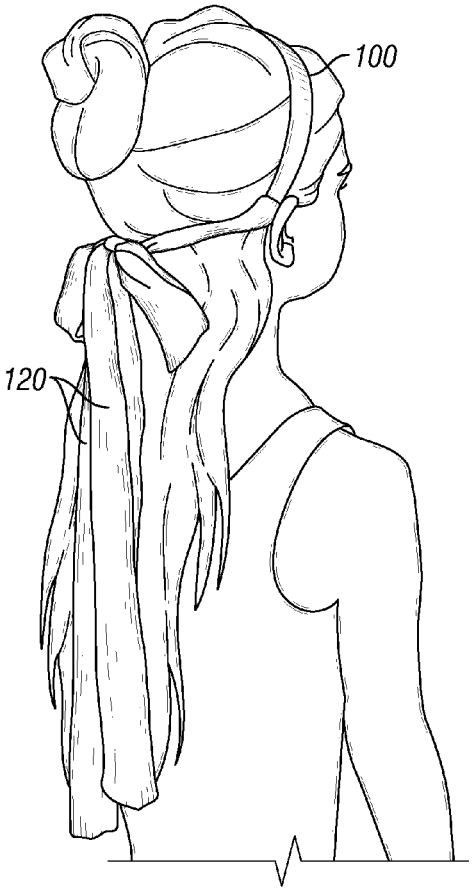
FIG. 5 depicts a rear perspective view of a person wearing the decorative headband.
Figure 6:
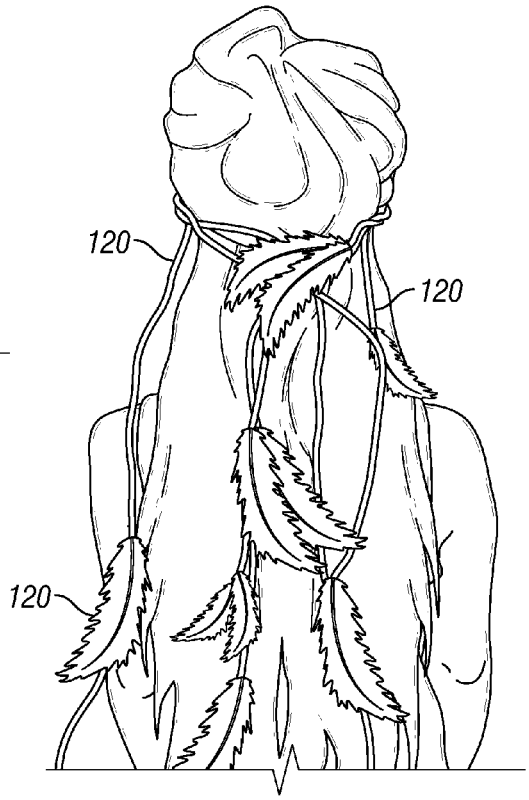
FIG. 6 shows a rear perspective view of a person wearing the decorative headband with the attached decorative leather strips of an alternate embodiment.

Referring now to FIGS. 2-5, embodiments of the present disclosure comprise decorative strips 120 made of fabric having aesthetically pleasing patterns or images. Such fabric strips may be cotton, polyester, silk, any other natural or manufactured fibers, or any blend thereof. As depicted in FIG. 6, in certain embodiments of the present disclosure, decorative strips 120 comprise multiple leather strips that may fashionably accessorize the wearer's outfit and/or the headband 100. As FIG. 6 illustrates, decorative strips 120 in some embodiments further comprise feather inserts. In alternative embodiments, decorative strips 120 include other types of decorative inserts to allow additional customization. Decorative inserts may comprise pins, patches, or other item that are removable from decorative strips 120. Alternatively, decorative inserts may be semi-permanently fixed to decorative strips 120. As used herein, "semi-permanent" means are affixed in a way so as to not be removable by the wearer in normal use. Examples of semi-permanent attachment means include glue, sewing, stapling, and the like.

Referring back to FIG. 3, headband 100 may further include decorative attachment 130 along the curve of the headband 100. In the embodiment depicted in FIG. 3, decorative attachment 130 comprises a fabric flower. In alternative embodiments, decorative attachment 130 comprises other aesthetically pleasing elements such as a brooch, beads, or leather strips. Decorative attachment 130 attaches to headband 100 by a spring-loaded clip. In certain embodiments, decorative attachment 130 attaches to headband 100 by a button and buttonhole combination. In alternative embodiments, decorative attachment 130 attaches to headband 100 by other means known in the art. In other embodiments, decorative attachment 130 is fixed to headband 100 by semi-permanent means.

Figure 3:
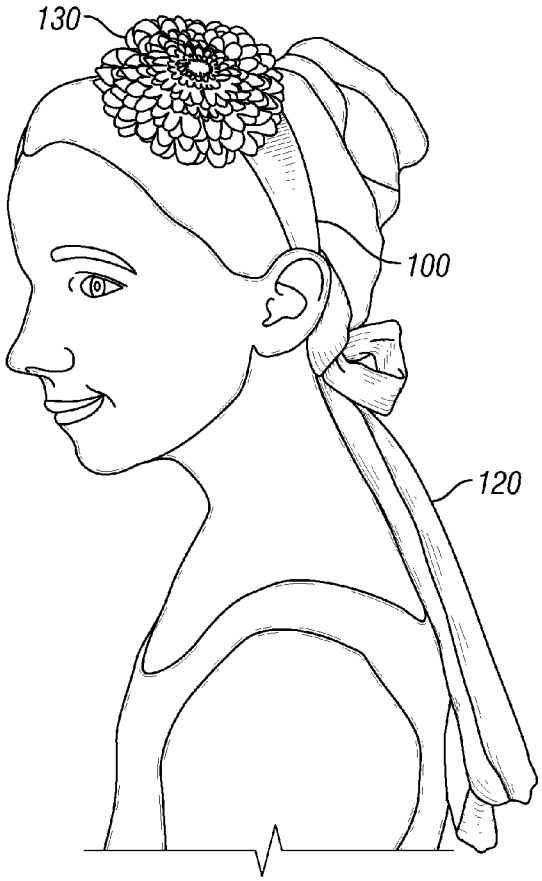
FIG. 3 depicts a side view of a person wearing the decorative headband.

In operation, a wearer may choose from multiple headbands 100 and multiple decorative strips 120, which she may selectively match to outfits to result in aesthetically-pleasing ensemble. As shown in FIGS. 3-5, decorative strips 120 may be tied together if desired by the wearer. Decorative strips 120 may be wrapped around the wearer's hair in addition to or instead of tying. Decorative strips 120 may be tied in an aesthetically-pleasing bow or other manner as desired by the wearer.

As will be understood by one of ordinary skill in the art having the benefit of this disclosure, embodiments disclosed herein may provide a wearer with many options to accessorize her headband with her outfits by selectively attaching decorative strips 120 and/or decorative attachments 130 to her headband 100. The modular nature of the headband 100 allows the wearer to mix and match headbands 100 with decorative strips 120 and/or decorative attachments 130 to result in desired combinations.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the spirit and scope of the present disclosure.

What is claimed is:

1. A modular decorative headband system comprising:

a resilient horseshoe-shaped headband comprising a top surface, a bottom surface, a first distal end, and a second distal end;

a first hook-and-loop attachment mechanism located at the first distal end;

a second hook-and-loop attachment mechanism located at the second distal end; wherein the first hook-and-loop attachment mechanism and the second hook-and-loop attachment mechanism are located on the top surface; and multiple decorative ribbon accessories removably attachable to the first hook-and-loop attachment mechanism and the second hook-and-loop attachment mechanism;

wherein the multiple decorative ribbon accessories are interchangeable.

2. The modular decorative headband of claim 1, wherein the multiple decorative ribbon accessories comprise one or more fabric strips.

3. The modular decorative headband of claim 1, wherein the multiple decorative ribbon accessories further comprise one or more leather strips.

4. The modular decorative headband of claim 1, further comprising a decorative attachment at a point along a curved section of the headband.

5. The modular decorative headband of claim 4, wherein the decorative attachment comprises an artificial flower.

6. A method of accessorizing a resilient horseshoe-shaped headband to a wearer's outfit, comprising:

putting the headband onto the wearer's head, the headband having a top surface, a bottom surface, and two distal ends;

selecting a decorative ribbon accessory to aesthetically match with an outfit of the wearer; and attaching the decorative ribbon accessory to at least one distal end of the top surface by a hook-and-loop attachment mechanism.

7. The method of claim 6, wherein the decorative accessory comprises multiple fabric strips, the method further comprising tying the fabric strips together in a knot.

* * * * *